US005667280A

United States Patent [19]

Hansen

[11] Patent Number: 5,667,280

[45] Date of Patent: Sep. 16, 1997

[54] SKATE WHEEL

[75] Inventor: David W. Hansen, Salt Lake City, Utah

[73] Assignee: Mechatronics, Inc., Preston, Wash.

[21] Appl. No.: 454,040

[22] Filed: May 30, 1995

Related U.S. Application Data

[63] Continuation-in-part of Ser. No. 67,324, May 25, 1993, abandoned.

[51] Int. Cl.[6] ..... B60C 7/24

[52] U.S. Cl. ..... 301/5.3; 152/323; 152/382; 152/396

[58] Field of Search ..... 301/5.3, 5.7, 64.7; 280/11.22, 11.23; 152/323, 382, 384, 393, 394, 395, 396, 397, 398, 402, 403

[56] References Cited

U.S. PATENT DOCUMENTS

| | | | |
|---|---|---|---|
| D. 301,908 | 6/1989 | Olson et al. . | |
| D. 321,393 | 11/1991 | Olson et al. . | |
| D. 323,540 | 1/1992 | Graham . | |
| D. 324,713 | 3/1992 | Rubin . | |
| D. 334,225 | 3/1993 | Graham . | |
| 864,333 | 8/1907 | Pilz . | |
| 960,212 | 5/1910 | Wiechard | 152/375 |
| 1,084,409 | 1/1914 | Divine | 152/323 X |
| 1,428,210 | 9/1922 | Boche . | |
| 1,469,344 | 10/1923 | Ware . | |
| 1,618,496 | 2/1927 | Ware . | |
| 1,674,087 | 6/1928 | Beemer . | |
| 1,697,485 | 1/1929 | Ware . | |
| 1,983,869 | 12/1934 | Nichol | 301/5.7 X |
| 2,034,948 | 3/1936 | Knapp | 301/5.7 |
| 2,048,916 | 7/1936 | Bentzlin . | |
| 2,105,354 | 1/1938 | Hill . | |
| 2,152,685 | 4/1939 | Grange et al. . | |
| 2,271,166 | 1/1942 | Weiss | 152/402 X |
| 2,276,570 | 3/1942 | Gaines . | |
| 2,291,600 | 8/1942 | Atkinson | 280/11.23 X |
| 2,412,290 | 12/1946 | Rieske . | |
| 2,837,376 | 6/1958 | Bruno . | |
| 2,848,278 | 8/1958 | Todd . | |
| 3,024,033 | 3/1962 | Skaggs . | |
| 3,501,162 | 3/1970 | Toone . | |
| 3,592,511 | 7/1971 | Hudelson . | |
| 3,815,959 | 6/1974 | Hill . | |
| 3,823,952 | 7/1974 | Kukulowicz . | |
| 3,895,844 | 7/1975 | Merbler . | |
| 3,900,203 | 8/1975 | Kukulowicz . | |
| 4,033,395 | 7/1977 | Berg et al. . | |
| 4,123,076 | 10/1978 | Passoni . | |
| 4,127,166 | 11/1978 | Wyman . | |
| 4,130,320 | 12/1978 | Racosky . | |
| 4,218,098 | 8/1980 | Burton | 152/323 X |
| 4,273,345 | 6/1981 | Peterson et al. . | |
| 4,294,455 | 10/1981 | Krueger . | |

(List continued on next page.)

FOREIGN PATENT DOCUMENTS

| | | | |
|---|---|---|---|
| 816753 | 8/1937 | France . | |
| 2244840 | 3/1974 | Germany | 301/5.7 |
| 61725 | 1/1912 | Switzerland . | |
| 1584 | of 1893 | United Kingdom . | |
| 549167 | 11/1942 | United Kingdom . | |
| WO 95/13928 | 5/1995 | WIPO . | |

*Primary Examiner*—Russell D. Stormer
*Attorney, Agent, or Firm*—Guy W. Chambers; Townsend and Townsend and Crew

[57] ABSTRACT

A skate wheel (10) having a configuration of hubs (24), tire (14), spacers (26) and bearing assembly (22) which firmly locks the tire in place and yet allows the tire, bearing assembly and spacer to be replaced independently from the rest of the wheel when appropriate. In the preferred embodiment, each hub is formed with an annular recess to hold the spacer and bearing assembly. The tire is firmly locked into the present wheel by virtue of an annular tire flange (18) of rectangular transverse cross-section which is received into each hub and by acutely V-shaped projections (23) from each hub which are received into the tire. Small gaps are provided between hubs and spacers to prevent torsional overload of the bearing assembly. Peaks and valleys can be formed in mating hub and tire surfaces to prevent rotation of the tire relative to the hub.

18 Claims, 4 Drawing Sheets

U.S. PATENT DOCUMENTS 4,408,803 10/1983 Green et al. .
4,573,510 3/1986 Ippen et al. .
4,603,025 7/1986 Landay et al. .
4,603,868 8/1986 Schutz .
4,666,169 5/1987 Hamill et al. .
4,909,523 3/1990 Olson .
5,028,058 7/1991 Olson .
5,048,848 9/1991 Olson et al. .
5,068,956 12/1991 Malewicz .
5,092,614 3/1992 Malewicz .
5,117,885 6/1992 Crawford ..... 152/323
5,190,301 3/1993 Crawford .
5,226,673 7/1993 Cech .
5,251,920 10/1993 Mc Hale .
5,308,152 5/1994 Ho .
5,470,086 11/1995 Peterson et al. .
5,564,790 10/1996 Leravich ..... 152/382 X

SKATE WHEEL

This is a continuation-in-part of U.S. patent application Ser. No. 08/067,324, filed May 25, 1993, and entitled "SKATE WHEEL" (now abandoned).

This invention relates to improvements in skate wheels of the type made for in-line skating equipment and, more particularly, to a skate wheel having a single bearing which can be quickly and easily mounted in place in a skate wheel.

BACKGROUND OF THE INVENTION

The various designs for in-line skate wheels have been known and used for over 50 years. However, a skate wheel suitable for use with a single bearing in a skate wheel has not been found or designed such that the advantages of such a wheel can be realized.

It has been found that a single bearing will handle skate wheel loads much better than any other type of wheel construction. Such a single bearing is lighter, faster to come up to speed and less expensive to manufacture. Thus, until the present invention, no one has designed a hub that will retain a tire and bearing under all skating conditions.

A study of skating conditions has revealed that when a hockey player, for instances, goes after a puck, or when a speed skater, for instance, comes out of racing blocks, the accelerating force applies loads to the front wheel tire of a conventional two-bearing wheel in a twisting motion. The magnitude of these loads have been sufficient to tear tires off the wheels even when the hubs are molded to the tire. Further, when a hockey player makes an abrupt turn to the right or to the left, forces are applied to the rear wheel of a skate in a twisting motion that creates severe wear on the rear wheels. This can early on separate the tire from the hub. Recreational skaters often encounter uncomfortable breaks or cracks on the surface over which they are skating with conventional wheels.

Accidents are a more serious result caused by wheel failure. Typically, if a recreational skater is going more than 25 mph, the wheels are turning 2,350 rpm. Any imperfections in the bearings, hub or tire are very noticeable and detract from the ease and enjoyment of skating. Moreover, two-bearing wheels for in line skates have not proven satisfactory. This is because loads are applied to the side of the wheel and the wheels are mounted in a two-bearing construction design.

A need, therefore, has continued to exist for some time for an improved skate wheel, particularly one with a single bearing. The present invention satisfies this need.

SUMMARY OF THE INVENTION

The present invention is directed to a skate wheel which is comprised of two hub halves or hubs which, when fastened together, simultaneously clamp and retain a single bearing and a tire in place on an axle bolt. The wheel also contains spacers on either side that locate the bearing on the axle bolt.

The present invention provides a single bearing wheel which has a number of improvements, including ridges and grooves, pins and holes, and a lock that locks the hubs and tire together as well as to fit between the tire and hubs. The skate wheel of the present invention uses the single bearing as a means to assure the strength, concentricity, roundness and squareness of the assembly. Spacers for the wheel are designed to provide a fail-safe feature for the bearing as well as a labyrinth seal to extend the life of the bearing.

Another aspect of the present invention is that the wheel is designed so as to be easy to assemble and to take apart for service, cleaning or replacement of tire and bearing. The hubs of the wheel are designed so that they can be made of plastic, molded or machined, so that the wheel can retain a tire designed for hockey, speed or recreational skating.

The primary object of the present invention is to provide an improved skate wheel which has a single bearing and which can be provided with plastic hubs associated with a single bearing to provide an improved connection to a tire.

Other objects of the present invention will become apparent as the following specification progresses, reference being had to the accompanying drawings for an illustration of the invention.

DETAILED DESCRIPTION OF THE PREFERRED EMBODIMENT

Figure 1:
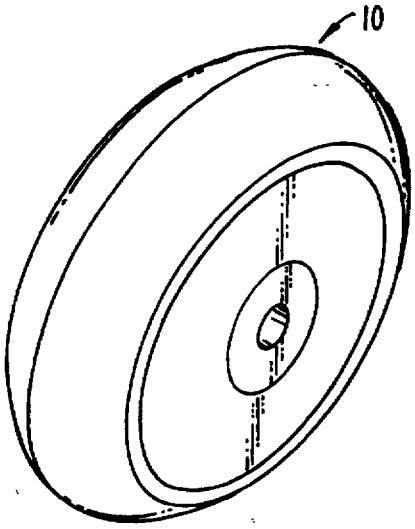
FIG. 1 is a perspective view of a first embodiment of the skate wheel of the present invention.
Figure 2:
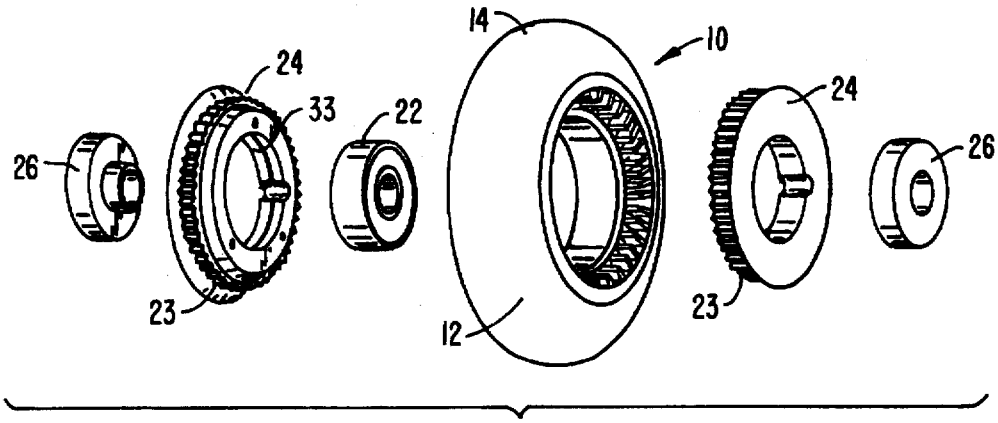
FIG. 2 is an exploded view of the skate wheel of FIG. 1.

A first and preferred embodiment of the skate wheel of the present invention is broadly denoted by the numeral 10 and it is comprised of a number of parts shown in FIG. 2. Wheel 10 includes a tire 12 which has an outer periphery 14 which is of one-piece construction as shown in FIG. 2. Any suitable material can be used to construct the tire. The tire is typically molded and can be made of urethane, urethane rubber, polyurethane and other plastic moldable materials.

Figure 3:
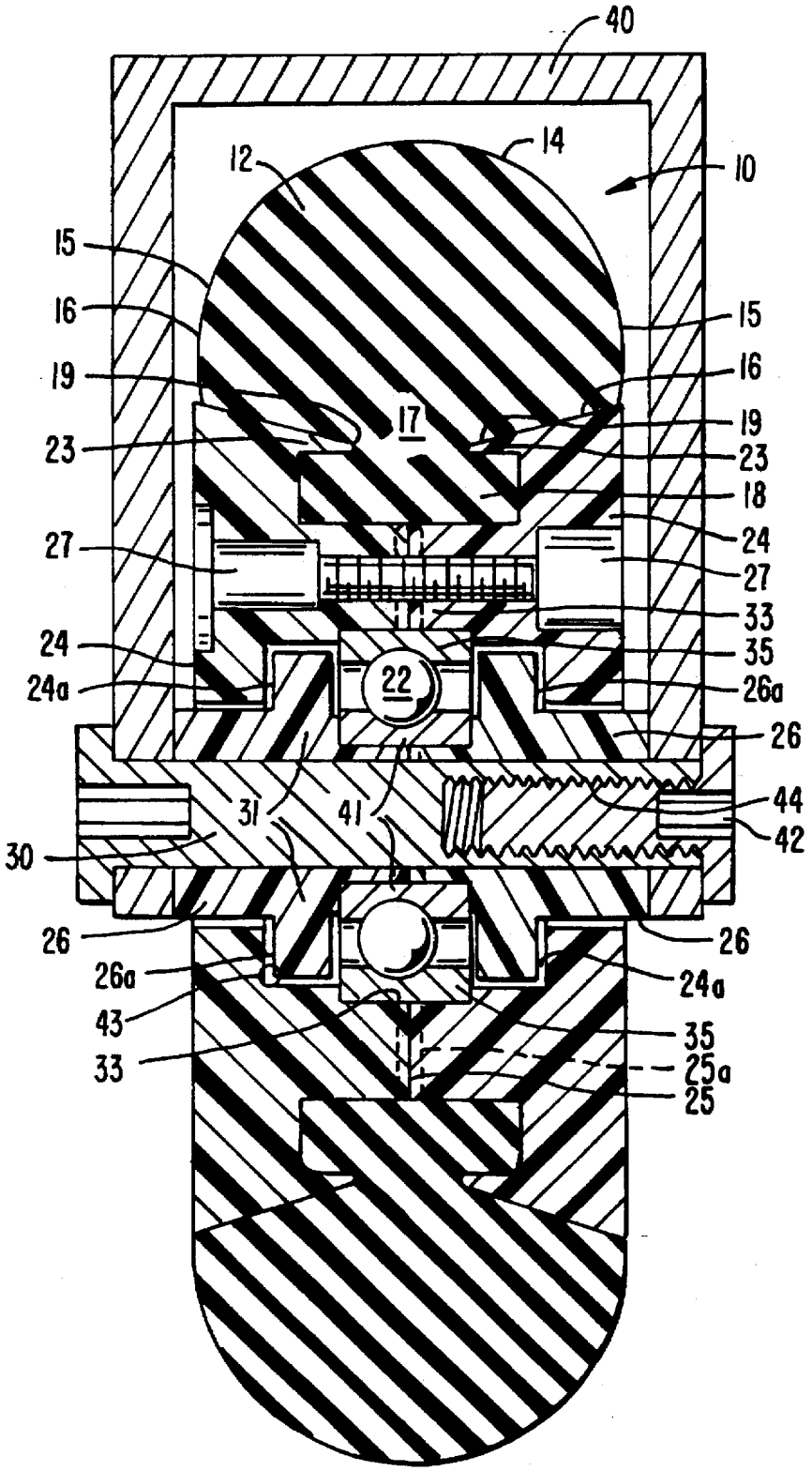
FIG. 3 is an enlarged, vertical section through the skate wheel, showing the way in which the same is mounted on a frame for attachment to a shoe.

Referring now to FIG. 3, the inner periphery of the tire, defined by a central opening, has a pair of annular, inclined surfaces 16 which converge toward each other from the opposed side faces 15 thereof. The tire is integral with an annular flange 18 which is rectangular in transverse cross section as shown in FIG. 3 and extends radially inwardly from the junction 17 between the tire and the flange 18. The flange 18 forms with the tire 12 a pair of annular, transversely V-shaped recesses 19 outboard of junction 17.

In addition to tire 12, skate wheel 10 further includes a single bearing 22 which is mounted concentric to the tire 12 as hereinafter described. Also, a pair of hub halves or hubs 24 and a pair of spacer bushing 26 are coupled with tire 14 and bearing 22 to contribute to the assembly of the skate wheel.

The hubs 24 clamp onto flange 18 and are thereby coupled to the tire 14 as shown in FIG. 3. The hubs each have an annular transversely V-shaped projection 23 which is complementally received within the adjacent annular V-shaped recess 19 (FIG. 3). The snug fit between the projections 23 and recesses 19 assure a good clamping and locking action by hubs 24 on flange 18.

The hubs are in face-to-face contact with each other along a central line 25 and the hubs have mating holes 27 which extend through the hubs and surround a bolt which extends through the hubs and are interconnected thereto to clamp the hubs to the flange 18. The hubs are preferably made of plastic and can be spot welded or welded 25*a* along the line 25 to connect the hubs to the tire.

A spacer bushing 26 is provided for each hub, respectively, the spacer bushings 26 being denoted at their main body portion by the numeral 31 and shown in FIG. 3. The spacer bushings are on opposite sides of the single bearing 22 (FIG. 3) and the spacer bushings retain the bearing in place in an annular recess 33 defined by inner, annular peripheral surfaces in the adjacent hubs 24. The outer race 35 of bearing 22 is captured in each recess 33 so that the bearing is locked in place and is also held against axial movement with respect to the hubs and tire.

The outer diameter of the spacer bushings 26 are slightly smaller than the hub inner peripheral surface 24*a*. This is shown in FIG. 3 in which the spacer bushing outer surface 26*a* is slightly less in radial dimension than the corresponding hub inner periphery 24*a*. This feature prevents the bearing 22 from being twisted from its seat whenever tire 12 encounters heavy lateral impact loads. The bushing clearance is adjusted so that, in the event of impact excessive load, the ball bearing moves relative to the tire 12 in the plastic housing, and the bushing absorbs the overload. The clearance is in the range of 0.005" to 0.015", more nearly 0.010".

Bolt 30 passes through the holes provided by the center holes in spacer bushings 26. The inner race 41 is fixed relative to bolt 30 so that the tire rotates about the axis of bolt 30 by virtue of the outer race 35 being rotatable relative to the inner race 41 of the bearing.

Axle bolt 30 is coupled to a skate frame 40 by end threaded cap 42 which is threaded into the interior 44 of the bolt 30. The skate frame 40 is adapted to be coupled to a shoe (not shown) of a skate for coupling the skate wheel 10 to the shoe. A clearance 43 is provided to cause the ball bearing to move, in case of overload, relative to the plastic housing of the hubs and the spacer bushings to absorb the overload.

In use, the skate wheel is mounted to skate frame 40 and the skate frame 40 is coupled to a shoe. The skate frame can carry other skate wheels 10. Typically, there are three to six skate wheels coupled to the skate frame.

In assembling the skate wheel described above, the tire and one of the hubs are coupled together. For example, the left hand hub of FIG. 2 is first inserted into the side opening of the tire such that the annular projection of the hub 23 is inserted in the V-shaped recess 19 of the tire. Then, the corresponding spacer bushing 26 is forced into the interior of the hub from the opposite side opening of the tire so that the annular parts 26*a* of the spacer bushing 26 will be substantially contiguous with the adjacent part 24*a*. Following this, the bearing is put into place in the recess 33 and into abutment with the spacer bushing 26.

The next part to be introduced is another spacer bushing 26 for the right side of the wheel 10 as shown in FIG. 3. It is mounted on the bearing 22 so that the bearing is clamped and held in place by the bushing parts 26. Finally, the last wheel part is put into place, this part being the outer hub 24 at the right side of the wheel as shown in FIG. 3, following which a weld 25*a* can be made along line 25. Also, a bolt and nut or screw set can be put into place and tightened to more securely couple the hubs together with the hubs retaining the bushing clearance specified above.

To mount the wheel 10 on skate frame 40, the wheel is put in the frame and bolt 30 is put into place, following which caps 42 are coupled together to the ends of the bolt. The frame can then be coupled at its upper end to the shoe of the skate which is to be provided with a skate wheel.

Figure 4:
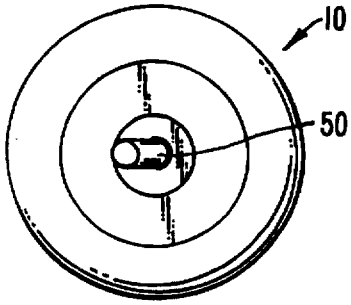
FIGS. 4 and 5 are side elevational views of the wheel of FIG. 1, showing the way in which a tool can be used to remove the single bearing from a plastic hub of the skate wheel.
Figure 5:
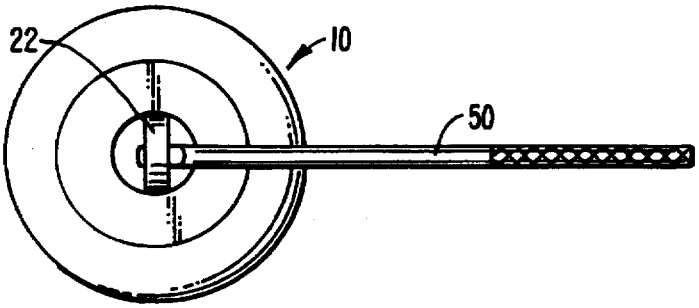

FIGS. 4 and 5 show sequential view of wheel 10 when it is desired to replace the bearing 22, such as when the bearing is defective for any reason. Since the hubs 24 are preferably of plastic, they are yieldable and a tool 50 can be inserted in the central hole reserved for the bolt 30, the tool 50 can be inserted in the hole and twisted through an angle of 90°, at which time the hubs will flex and, in this position of the bearing, as shown in FIG. 5, the bearing can be lifted with the fingers or another tool, such as pliers or the like. To install a new bearing, the reverse of the foregoing sequence is done with the bearing rotated into place while the hubs 24 flex or yield to the generally unchangeable diameter of the bearing itself.

Figure 6:
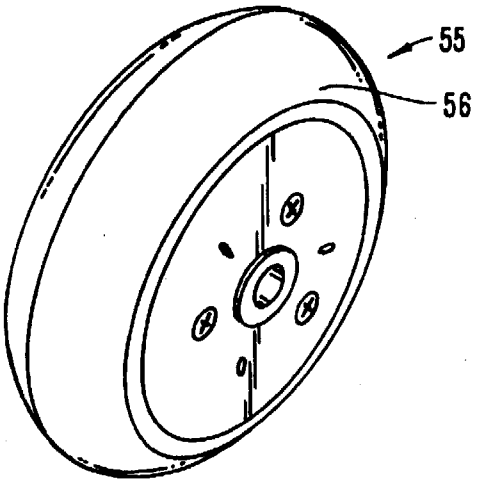
FIG. 6 is a view similar to FIG. 2 but showing a wheel of a second embodiment.
Figure 7:
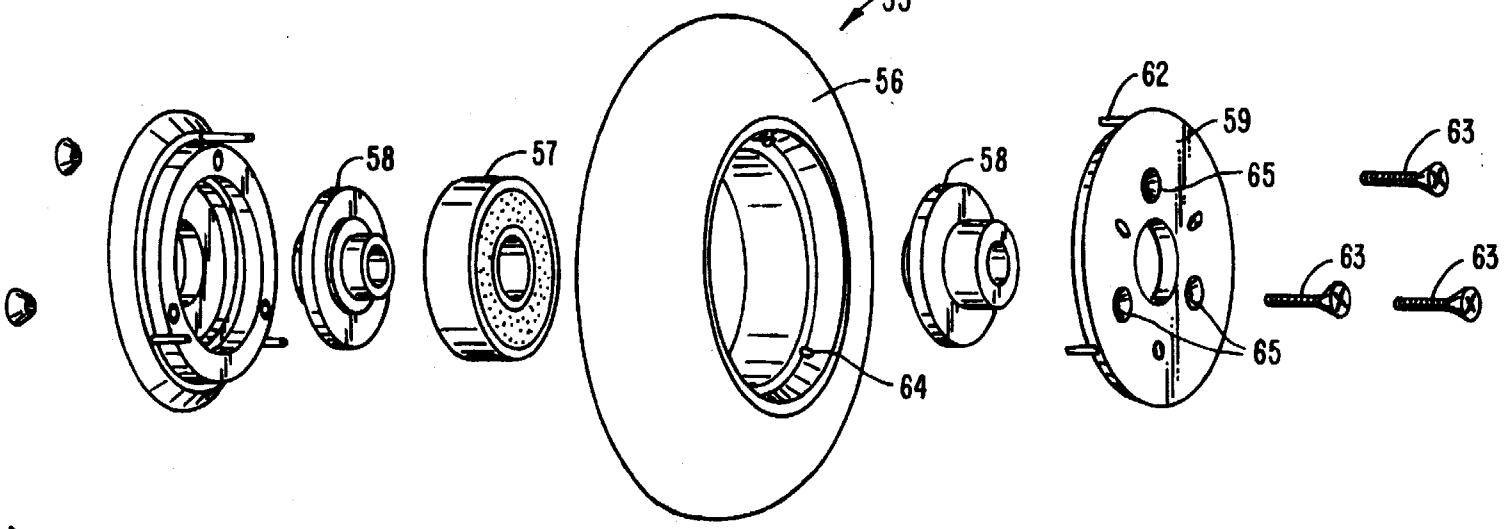
FIG. 7 is a view showing the wheel of FIG. 6 exploded.
Figure 8:
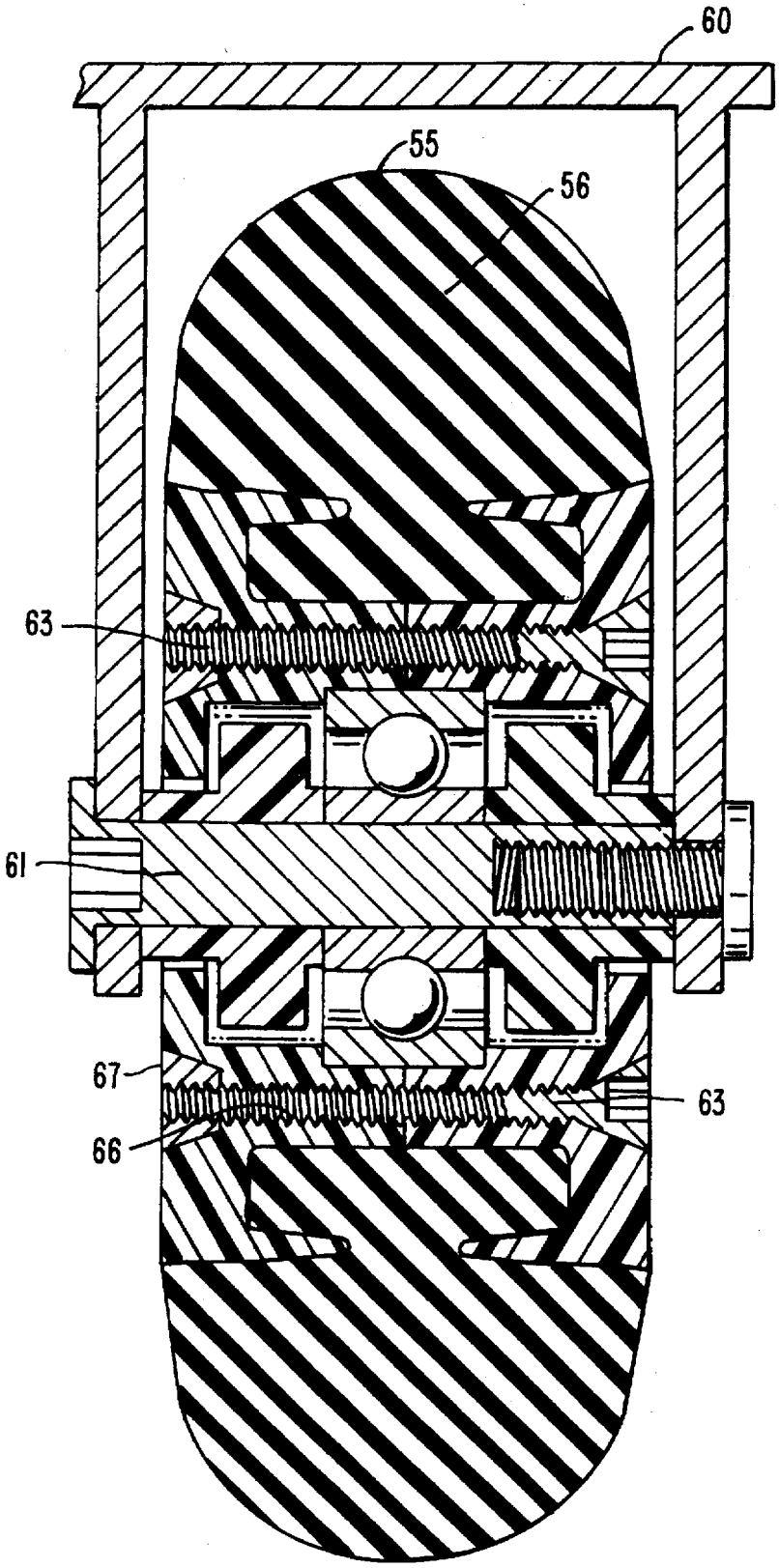
FIG. 8 is a vertical section through the wheel of FIG. 6.

Another embodiment of the invention is shown in FIGS. 6–8. In this embodiment, a wheel 55 has a number of parts including a tire 56, a single bearing 57, a pair of spacers 58 and a pair of hubs 59. The embodiment of FIGS. 6–8 is used when it is desired to couple the parts together so that they can be released and separated to permit replacement of the tire or bearing or both. The wheel has a frame 60 (FIG. 8) which is coupled to the center bolt 61 so as to connect the wheel to a shoe.

The tire 56 has a flange 63 which is the same in function as flange 18 of the first embodiment shown in FIG. 3. The shape and cross section of the hubs are substantially the same as those shown in FIG. 3 for the first embodiment, and the spacers 58 are also the same cross section as that shown in FIG. 3. Clearance spaces or gaps can be provided as described above with the wheel 55 so that loads caused by twisting of the wheel can be absorbed without damage to the wheel.

The hubs 59 are provided with alignment pins 62 which extend axially and are spaced outwardly from the common central axis of the hubs. These pins are provided to align the hubs precisely such that the screws 63 (FIG. 7) can be properly inserted into the holes provided for the screws 63 in the hubs in the event that installed hubs are used. Such pins 62 are inserted into holes molded in the tire denoted by the numeral 64. These holes 64 are on opposite sides of flange 63 of tire 56.

During assembly, the bearing is first put into place in the wheel, following which the two spacers 58 are put into the tire on opposite sides of the bearing, following which the hubs are put into opposite sides of the spacers with the pins 62 of the hubs entering specific holes 64 at the sides of the flange 63. Screws 63 are then placed in the holes 65 provided for hubs 59 and after passing through the holes 64 and then through passages 66 in the hubs, the screws 63 emerge and are coupled to the assembly by nuts 67. In this way, the screws and nuts serve as connecters which eliminates the need for a weld as in the first embodiment of the invention. Thus, the hubs can be of plastic or metal in the second embodiment.

It has been found that a whine or a squeal may be heard as the surfaces defining the recesses 19 move relative to the tire. This relative movement causes the whine or squeal. To eliminate the squeal, one or more of the surfaces defining the V-shaped recesses 19 are knurled (FIG. 2). This essentially takes away the differential movement and the squeal can no longer be heard.

I claim:

1. A skate wheel comprising:

a tire having sides, a central opening and a central axis;

a pair of hubs adapted to be coupled to said tire and to extend into said central tire opening from respective sides of said tire, each of said hubs having an annular recess to accommodate a bearing assembly and a spacer;

a bearing assembly within said annular hub recesses and having a central axis coincident with the central axis of said tire;

a pair of spacers on opposite axial sides of the bearing assembly, said spacers being retained adjacent to the bearing assembly and within said annular hub recesses; and means to both couple said pair of hubs together and retain said spacers within said annular hub recesses.

2. A skate wheel as set forth in claim 1, wherein said means to couple said pair of hubs includes a weld between the two hubs.

3. A skate wheel as set forth in claim 1 wherein said pair of hubs are formed of plastic material.

4. A skate wheel as set forth in claim 1, wherein said pair of hubs are formed of metal.

5. A skate wheel as set forth in claim 1, wherein said hubs are bondable.

6. A skate wheel comprising:

a tire having sides, a central opening and a central axis;

a pair of hubs adapted to be coupled to said tire and to extend into said central tire opening from respective sides of said tire;

a bearing assembly positioned between said hubs and having a central axis coincident with the central axis of said tire;

a pair of spacers on opposite axial sides of the bearing assembly wherein there is a gap between said bearing assembly and each spacer; and means to couple said pair of hubs together.

7. A skate wheel comprising:

a tire having sides, a central opening and a central axis;

a pair of hubs adapted to be coupled to said tire and to extend into said central tire opening from respective sides of said tire;

a bearing assembly positioned between said hubs and having a central axis coincident with the central axis of said tire;

a pair of spacers on opposite axial sides of the bearing assembly wherein there are gaps between said hubs and spacers; and means to couple said pair of hubs together.

8. A skate wheel as set forth in claim 7, wherein said gaps between said hubs and spacers are in the range of 0.005" and 0.015".

9. A skate wheel comprising:

a tire having sides, a central opening and a central axis;

a pair of hubs adapted to be coupled to said tire and to extend into said central tire opening from respective sides of said tire;

a bearing assembly positioned between said hubs and having a central axis coincident with the central axis of said tire;

a pair of spacers on opposite axial sides of the bearing assembly wherein there are gaps between said spacers and bearing assembly and gaps between said hubs and spacers; and means to couple said pair of hubs together.

10. A skate wheel as set forth in claim 1, wherein said means to couple includes a bolt.

11. A skate wheel comprising:

a tire having sides, a central opening, a central axis and an annular flange on its inner periphery with surfaces which are substantially parallel to said central axis;

a pair of hubs adapted to be coupled to said tire and to extend into said central tire opening from respective sides of said tire;

a bearing assembly positioned between said hubs and having a central axis coincident with the central axis of said tire;

a pair of spacers on opposite axial sides of the bearing assembly; and, means to couple said pair of hubs together.

12. A skate wheel comprising:

a tire having sides, a central opening, a central axis and an annular flange on its inner periphery which is substantially rectangular in transverse cross-section;

a pair of hubs adapted to be coupled to said tire and to extend into said central tire opening from respective sides of said tire;

a bearing assembly positioned between said hubs and having a central axis coincident with the central axis of said tire;

a pair of spacers on opposite axial sides of the bearing assembly; and, means to couple said pair of hubs together.

13. A skate wheel comprising:

a tire having sides, a central opening, central axis and a pair of acutely V-shaped recesses;

a pair of hubs adapted to be coupled to said tire and to extend into said central tire opening from respective sides of said tire, wherein each of said hubs has an acutely V-shaped annular projection which is received into one of said acutely V-shaped tire recesses;

a bearing assembly positioned between said hubs and having a central axis coincident with the central axis of said tire;

a pair of spacers on opposite axial sides of the bearing assembly; and, means to couple said pair of hubs together.

14. A skate wheel as set forth in claim 13, wherein one surface of said annular hub projection has peaks and valleys.

15. A skate wheel as set forth in claim 13, wherein one surface of said annular hub projection and the adjacent surface of said tire recess have mating peaks and valleys so as to prevent relative rotation therebetween.

16. A skate wheel comprising:

a tire having sides, a central opening, central axis, an annular flange on its inner periphery with surfaces which are substantially parallel to said central axis and a pair of acutely V-shaped recesses;

a pair of hubs adapted to be coupled to said tire and to extend into said central tire opening from respective sides of said tire, wherein each of said hubs has an acutely V-shaped annular projection which is received into one of said acutely V-shaped tire recesses;

a bearing assembly positioned between said hubs and having a central axis coincident with the central axis of said tire;

a pair of spacers on opposite axial sides of the bearing assembly; and, means to couple said pair of hubs together.

17. A skate wheel as set forth in claim 16, wherein said tire surfaces which are substantially parallel to said central tire axis are substantially rectangular in transverse cross-section.

18. A skate wheel comprising:

a tire having a central axis and a central opening;

a pair of hubs adapted to be coupled to said tire and to extend into said opening from respective opposed sides of said tire;

a single bearing assembly between said hubs and having a central axis coincident with the central axis of said tire;

a pair of spacers on opposite sides of said bearing assembly;

and bolt means for clamping the hubs against the spacers;

there being a first gap between said spacers and bearing assembly and a second gap between said hubs and spacers.

* * * * *